US007488208B2

(12) United States Patent
Takahashi et al.

(10) Patent No.: US 7,488,208 B2
(45) Date of Patent: Feb. 10, 2009

(54) CONNECTOR CONFIGURATION

(75) Inventors: Shinji Takahashi, Niwa-gun (JP); Yoshiaki Kato, Niwa-gun (JP); Harehide Sasaki, Niwa-gun (JP); Katsumasa Matsuoka, Niwa-gun (JP); Hiroshi Kobayashi, Okazaki (JP)

(73) Assignee: Kabushiki Kaisha Tokai-Rika-Denki-Seisakusho, Aichi-ken (DE)

( * ) Notice: Subject to any disclaimer, the term of this patent is extended or adjusted under 35 U.S.C. 154(b) by 0 days.

(21) Appl. No.: 11/778,179

(22) Filed: Jul. 16, 2007

(65) Prior Publication Data

US 2008/0020595 A1 Jan. 24, 2008

(30) Foreign Application Priority Data

Jul. 18, 2006 (JP) ..... 2006-195631

(51) Int. Cl.
*H01R 13/66* (2006.01)

(52) U.S. Cl. ..... 439/570

(58) Field of Classification Search ..... 439/570, 439/569, 571

See application file for complete search history.

(56) References Cited

U.S. PATENT DOCUMENTS 5,186,654 A * 2/1993 Enomoto et al. ..... 439/570
5,232,379 A * 8/1993 Lai ..... 439/570
5,961,347 A * 10/1999 Hsu ..... 439/570
6,083,045 A * 7/2000 Chiu ..... 439/570
6,334,789 B1 * 1/2002 Koyama ..... 439/570
6,468,094 B2 * 10/2002 Kuo ..... 439/108
6,478,617 B2 * 11/2002 Fan ..... 439/570
7,001,212 B1 * 2/2006 Juntwait ..... 439/566

FOREIGN PATENT DOCUMENTS

JP 5-15347 U 2/1993

* cited by examiner

*Primary Examiner*—Gary F. Paumen
(74) *Attorney, Agent, or Firm*—Roberts Mlotkowski Safran & Cole, P.C.; Thomas W. Cole

(57) ABSTRACT

This connector configuration comprises: a fixing member that is a component of a connector and is fixed to a substrate in order to mount the connector onto the substrate; a case that is a component of the connector and has an installation groove formed thereon, into which the fixing member is installed; and a regulating portion provided at either one of the fixing member and the case along the direction of installation of the fixing member to the case. A regulating groove is provided along the direction of installation on the other one of the fixing member and the case, and when the fixing member is installed onto the case, the regulating portion is guided along the regulating groove and tilting of the fixing member relative to the direction of installation is controlled.

5 Claims, 7 Drawing Sheets

12
16
18
20
22
24
30
32
32A
14
26
28
RH
FR 12
16
30
32A
28
C
26
14
32
UP
RH 12
22
18
24
20
26
14
16
30
32
28
32A
UP
FR

CONNECTOR CONFIGURATION

CROSS-REFERENCE TO RELATED APPLICATION

This application claims priority under 35 USC 119 from Japanese Patent Application No. 2006-195631, the disclosure of which is incorporated by reference herein.

BACKGROUND OF THE INVENTION

1. Field of the Invention

The present invention relates to a connector configuration wherein a fixing member is installed to a case.

2. Description of the Related Art

Among conventional connector configurations, there is a connector device wherein contacts are inserted into through-holes of a housing so as to be installed to the housing. (For example, see the Official Gazette of JU-A No. 5-15347.)

In this kind of connector configuration, when the contacts are installed to the housing, slanted installation of the contacts to the housing can be suppressed as long as the inclination of the contacts relative to the direction of installation to the contact housing can be controlled.

SUMMARY OF THE INVENTION

The present invention was made in order to solve the above-described problem, and the first aspect for achieving the above object is a connector configuration comprising: a fixing member that is a component of a connector and which is fixed to a substrate in order to mount the connector on the substrate; a case that constitutes the connector and has an installation groove formed thereon and into which installation groove the fixing member is installed; and a regulating portion provided at one of the fixing member and the case along the direction of installation of the fixing member to the case; wherein a regulating groove is provided along the direction of installation at the other one of the fixing member and the case, and when the fixing member is installed into the case, the regulating portion is guided along the regulating groove and inclination of the fixing member relative to the direction of installation is controlled.

The second aspect for achieving the above object relates to the connector configuration of the first aspect, wherein the regulating portion is provided so as to protrude out from the fixing member.

The third aspect for achieving the above object relates to the connector configuration of the first or the second aspect, comprising a fixing portion that is formed so as to protrude from the fixing member and is fixed to the substrate.

The fourth aspect for achieving the above object relates to the connector configuration of the second aspect, wherein the regulating portion is formed by bending a portion of the fixing portion.

The fifth aspect for achieving the above object relates to the connector configuration of the third or the fourth aspect, wherein the fixing portion is formed by bending a portion of the fixing member.

In the connector configuration according to the first aspect, the fixing member and the case form the connector. The fixing member is installed to the installation groove of the case and the fixing member is fixed to the substrate, which is thereby equipped with the connector.

Here, the regulating groove is provided along the direction of installation at one of the fixing member or the case (i.e., in the direction in which the fixing member is installed to the case). Also, a regulating groove is provided at the other one of the fixing member or the case along the direction of installation. When the fixing member is installed to the case, the regulating portion is guided along the regulating groove, and tilting of the fixing member relative to the direction of installation is suppressed. For this reason, tilted installation of the fixing member to the case can be suppressed.

In the connector configuration according to the second aspect, the regulating portion is provided so as to protrude from the fixing member so when installing the fixing member to the case, it is possible to regulate or control tilting in plural directions that cross of the fixing member relative to the installation direction. Accordingly, tilted installation of the fixing member to the case can be effectively prevented.

In the connector configuration according to the third aspect, a fixing portion is formed so as to protrude from the fixing member and is fixed to the substrate so the fixing member can be solidly fixed to the substrate, and accordingly, the connecter can be firmly fixed on the substrate.

In the connector configuration according to the fourth aspect, the fixing member is a board-shaped member and the regulating portion is formed by bending a portion of the fixing member. Accordingly, the regulating portion is formed integrally with the fixing portion, and accordingly, when installing the case onto the fixing member, the regulating portion does not drop out.

In the connector configuration according to the fifth aspect, the fixing member is a board-shaped member and the fixing portion is formed by bending a portion of the fixing member, and thus, the fixing portion can be integrally formed with the fixing member. Accordingly, by fixing the fixing portion to the substrate, the entire fixing member can be fixed firmly to the substrate.

DESCRIPTION OF THE PREFERRED EMBODIMENTS

First Exemplary Embodiment

Figure 1:
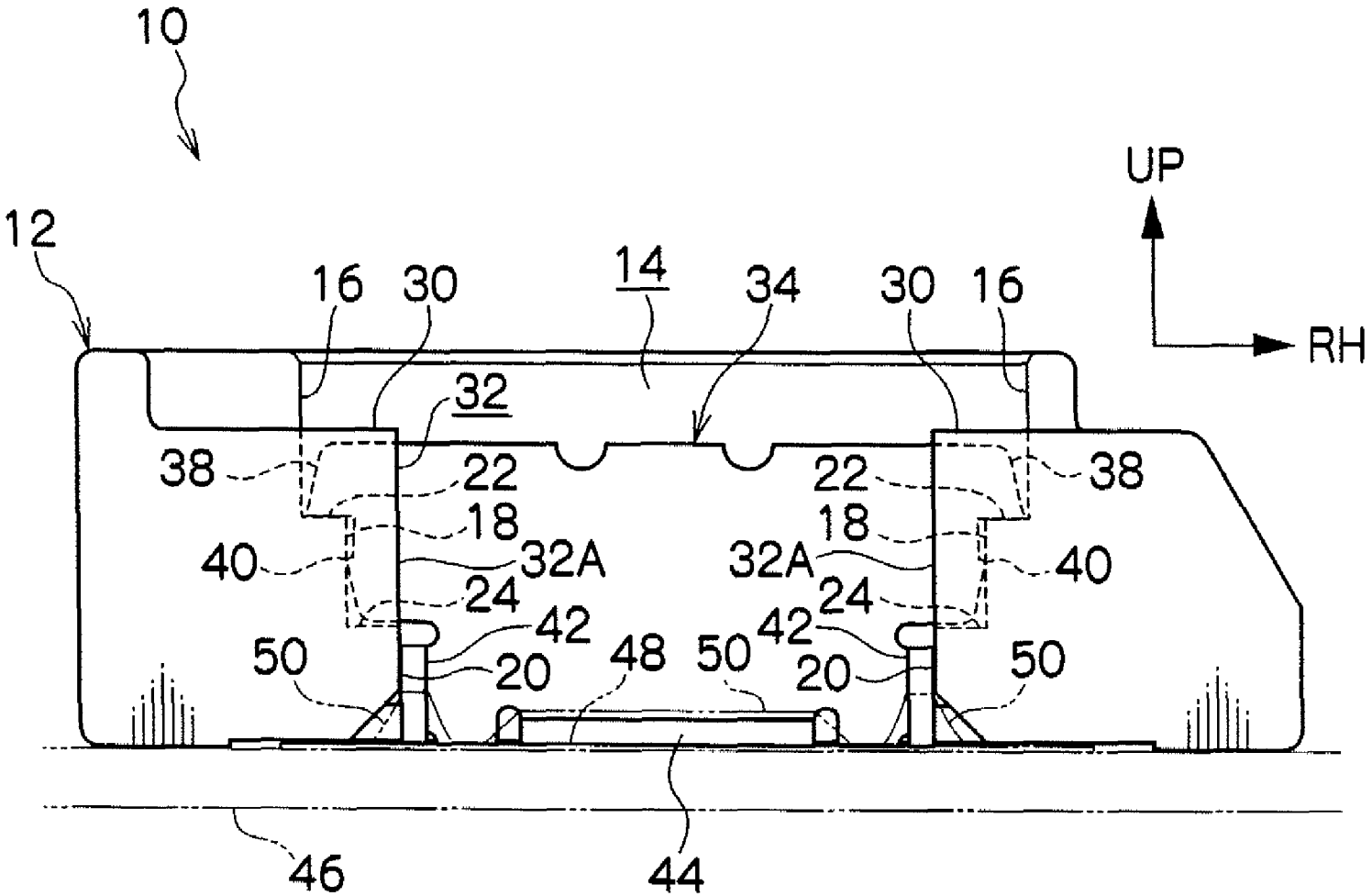
FIG. 1 is a frontal view showing the configuration of an SMT connector according to a first exemplary embodiment of the present invention as seen from the front.
Figure 2B:
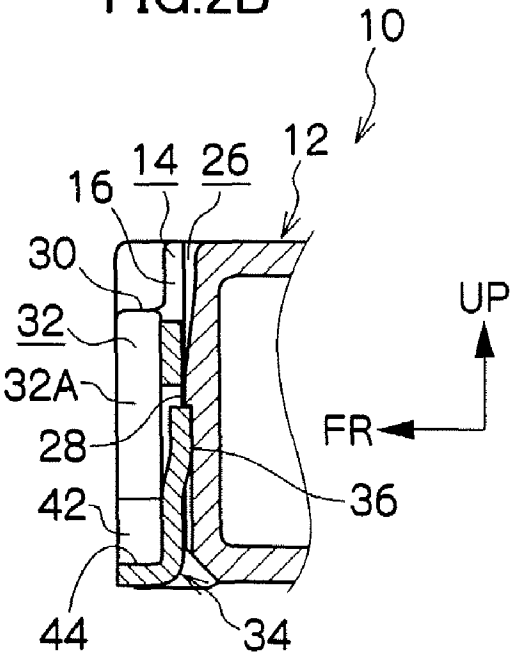
FIG. 2B is a cross-sectional view showing a cross section where the SMT connector is cut along the B-B line in FIG. 2A.
Figure 2A:
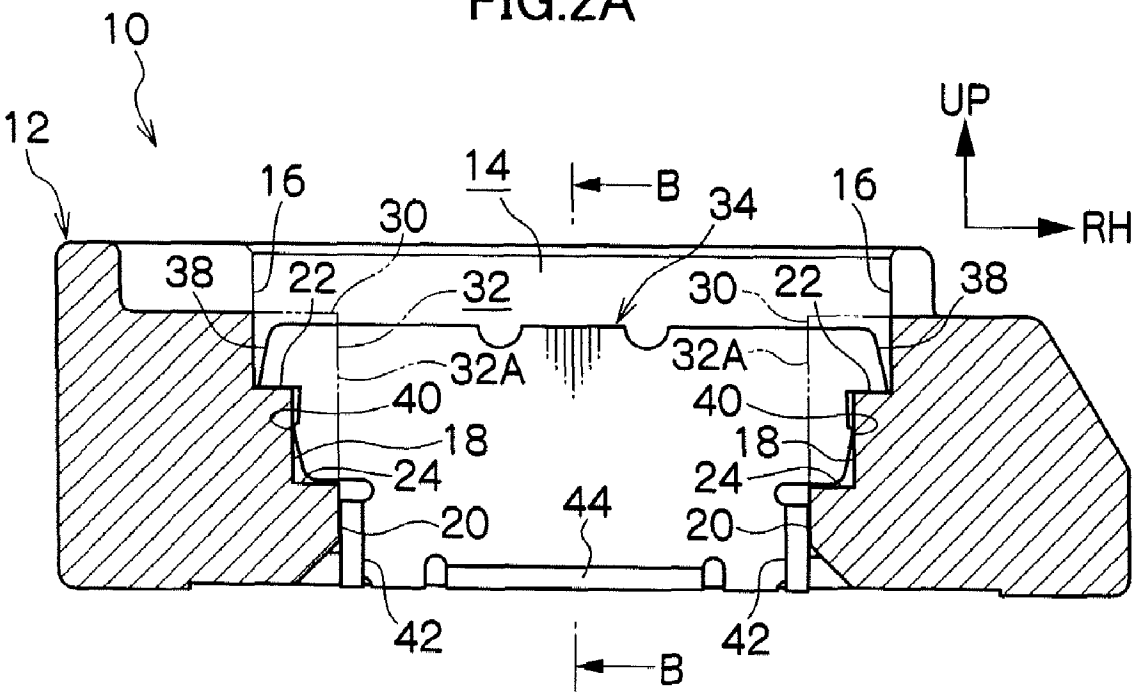
FIG. 2A is a cross-sectional view of the SMT connector according to a first exemplary embodiment as seen from the front.
Figure 3A:
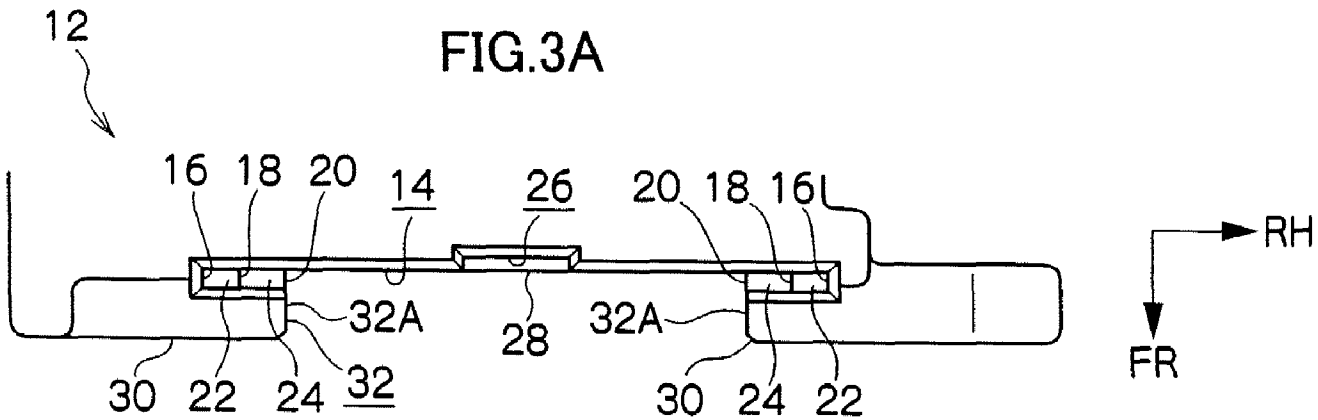
FIG. 3A is a plan view showing the case of the SMT connector according to the first exemplary embodiment.
Figure 3B:
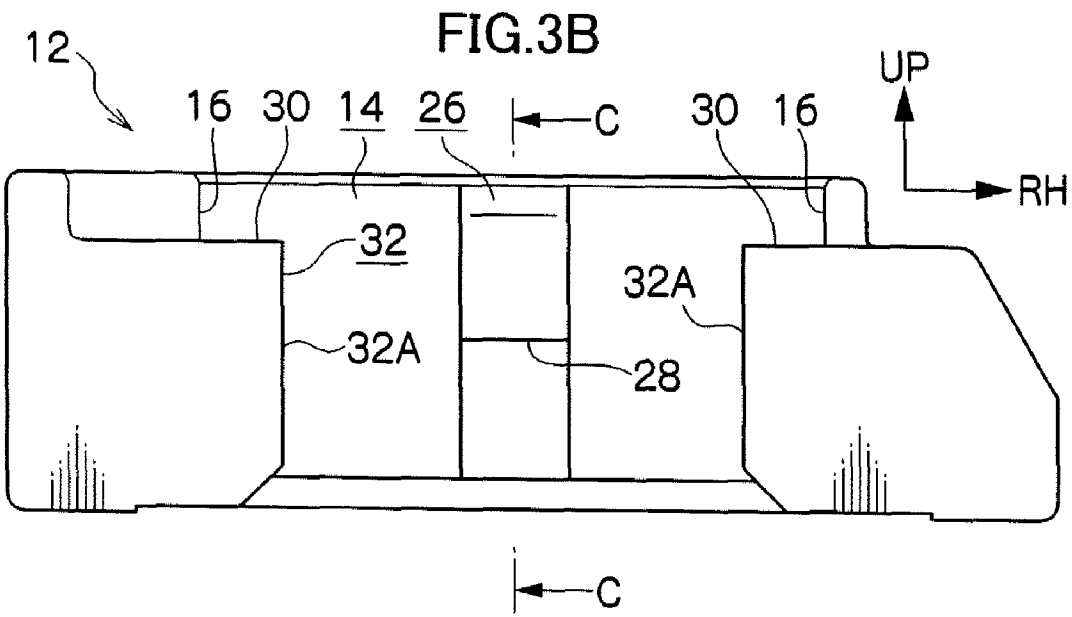
FIG. 3B is a frontal view of the case.
Figure 3C:
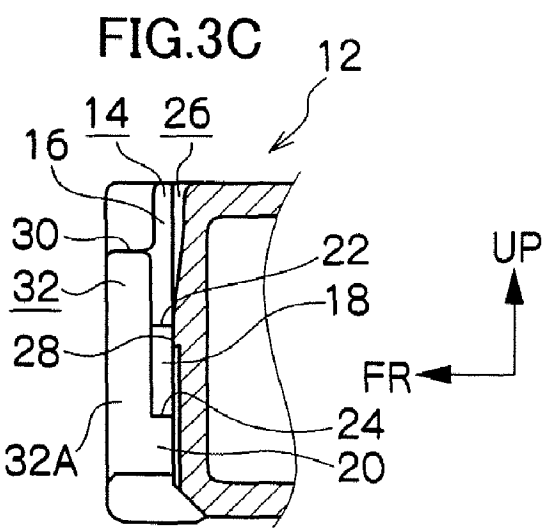
FIG. 3C is a cross-sectional view showing the case of FIG. 3B cut along the C-C line in FIG. 3B.
Figure 4A:
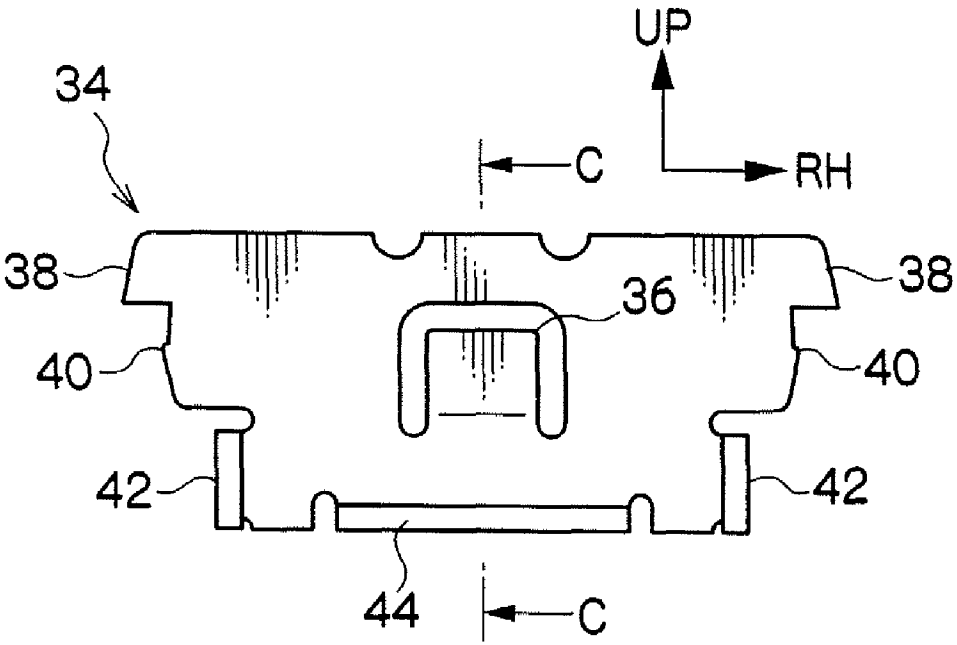
FIG. 4A is a frontal view showing a peg of the SMT connector according to the first exemplary embodiment as seen from the front.
Figure 4B:
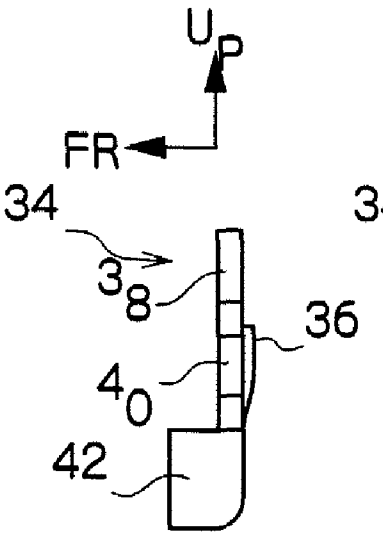
FIG. 4B is a side view of the peg as seen from the right.
Figure 4C:
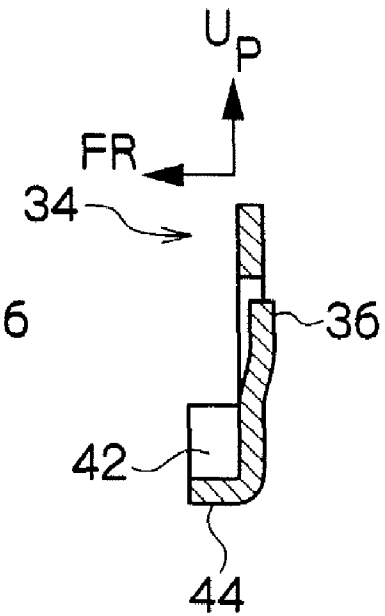
FIG. 4C is a cross-sectional view showing a cross section of the peg cut along the C-C line in FIG. 4A.
Figure 5B:
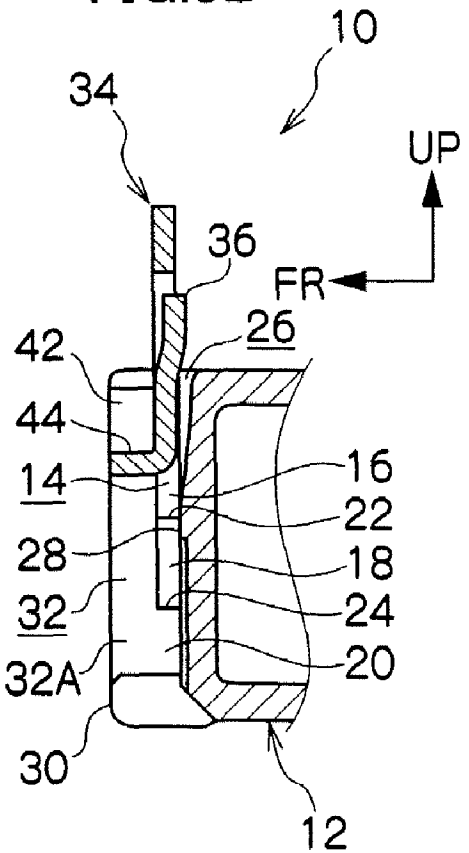
FIG. 5B is a cross-sectional view showing a cross section cut along the B-B line in FIG. 5A showing the SMT connector in the above-described state.
Figure 5A:
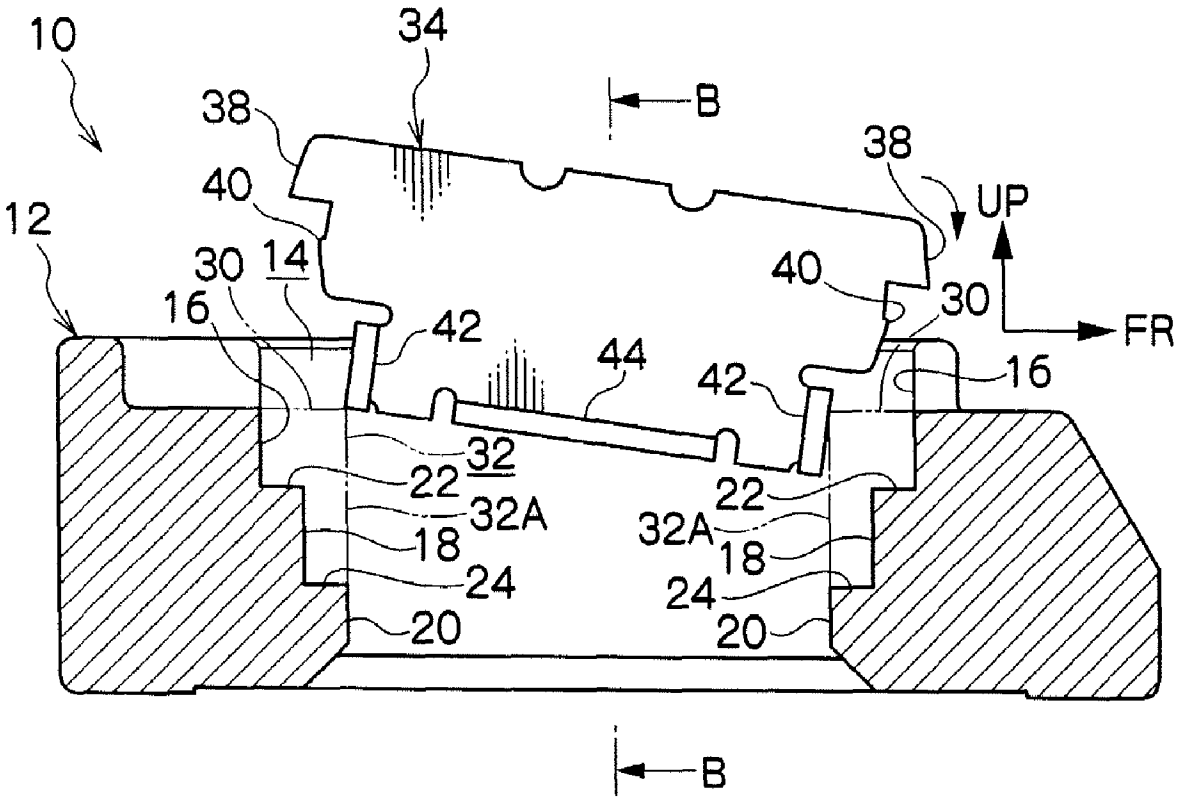
FIG. 5A is a cross-sectional view showing an initial state of installation of the peg to the case of the SMT connector according to the first exemplary embodiment as seen from the front.
Figure 6B:
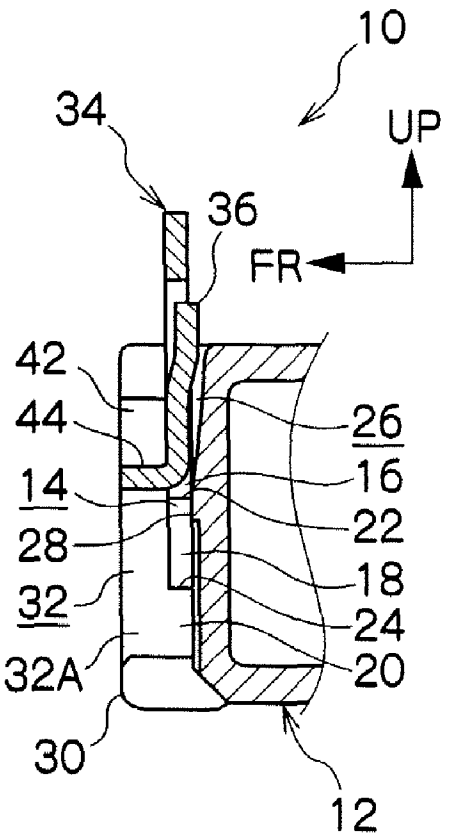
FIG. 6B is a cross-sectional view showing a cross-section cut along the B-B line in FIG. 5A that shows the SMT connector in that state.
Figure 6A:
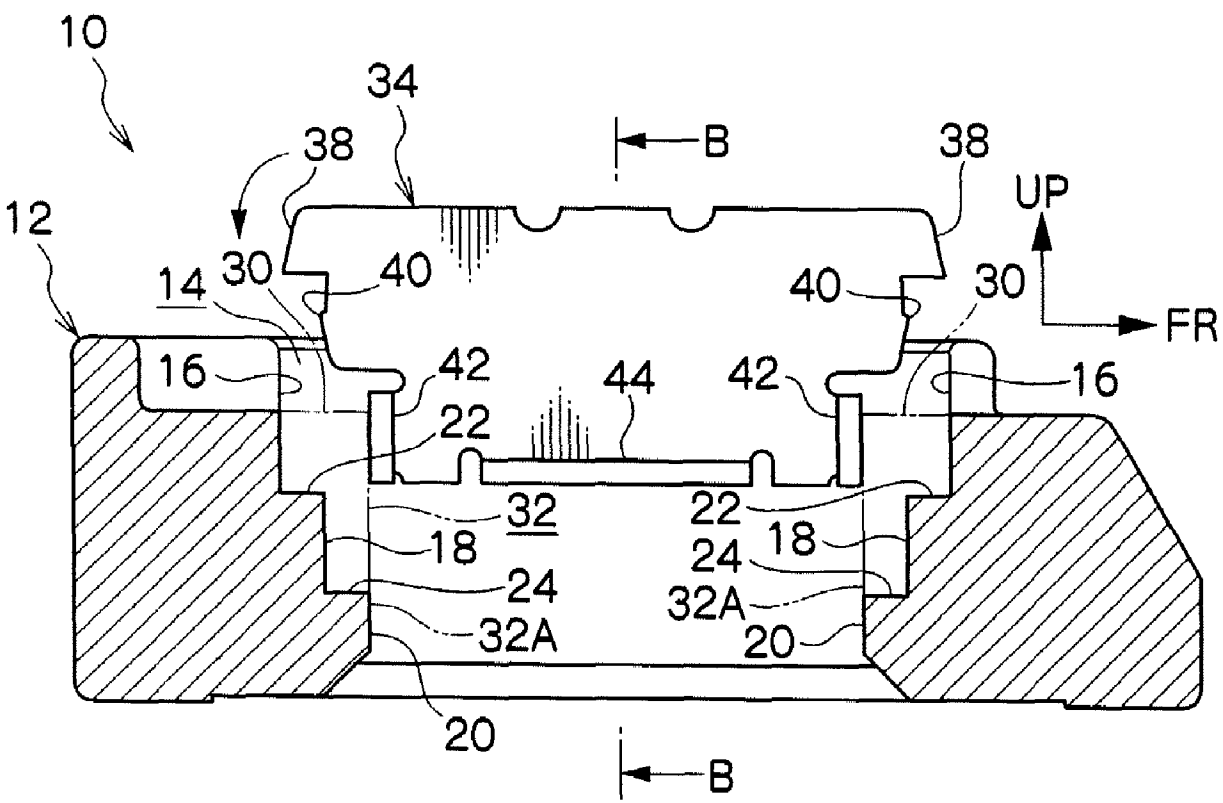
FIG. 6A is a cross-sectional view showing a state where the peg is in the process of being installed to the case of the SMT connector according to the first exemplary embodiment as seen from the front.
Figure 7B:
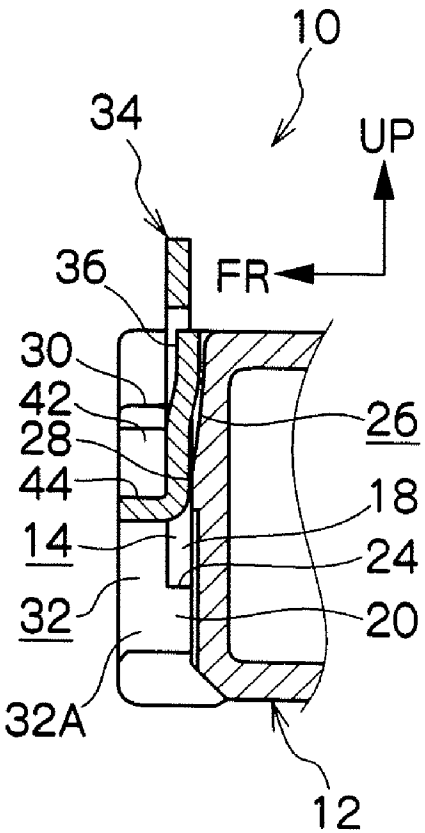
FIG. 7B is a cross-sectional view showing a cross-section cut along the B-B line in FIG. 5A that shows the SMY connector in the above state.
Figure 7A:
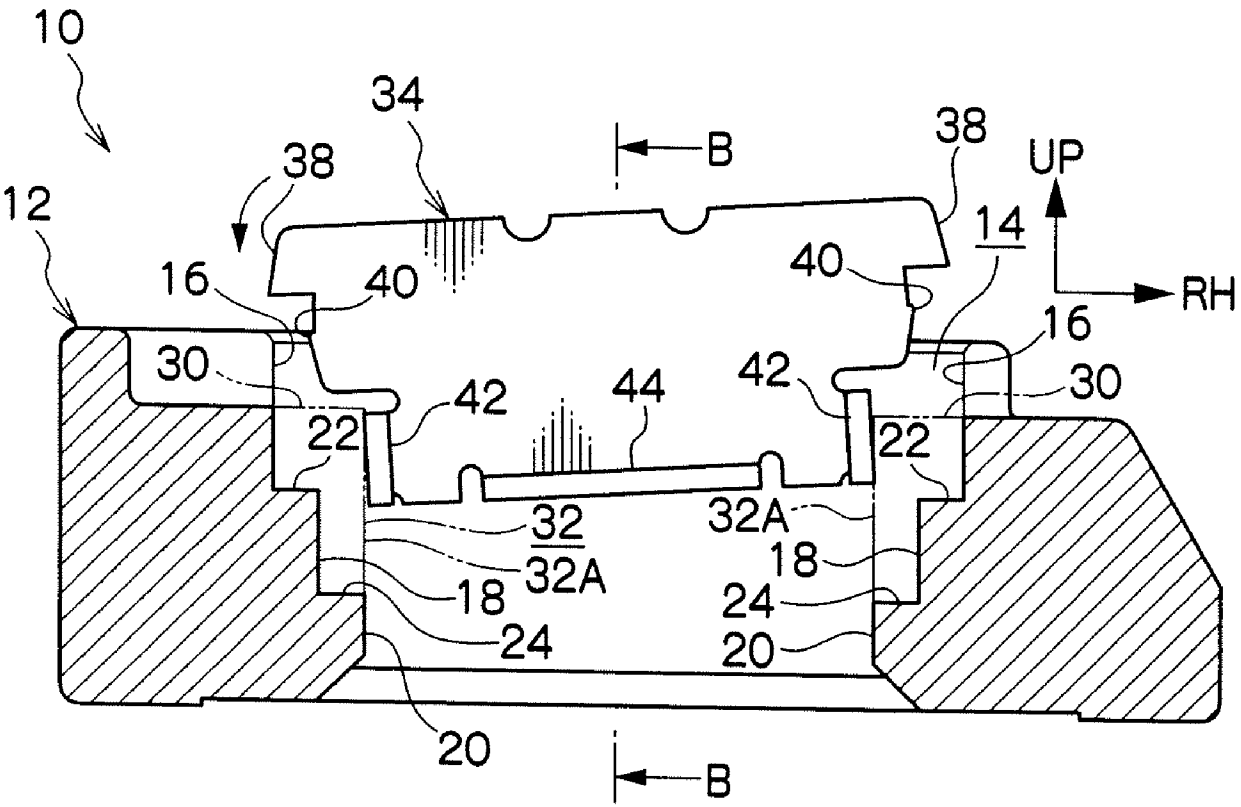
FIG. 7A is a cross-sectional view showing a state after installation of the peg to the case of the SMT connector according to the first exemplary embodiment as seen from the front.

A surface mount-type (SMT) connector 10 (i.e., surface-mounted connector) will be explained hereafter as a connector configured to which the connector configuration of the present invention has been applied. In FIGS. 1-7B, the FR arrows indicate the forward direction of the SMT connector 10, the RH arrows indicate the right direction of the SMT connector 10, and the UP arrows indicate the upward direction of the SMT connector 10.

The SMT connector 10 according the present embodiment is provided with a substantially rectangular container-shaped case 12 made out of resin, as shown in FIGS. 1, 2A, 2B, 3A, 3B, and 3C. The case 12 is equipped with electronic parts (not shown).

A substantially rectangular-shaped installation groove 14 (i.e., installation hole) is formed in the front portion of the case 12. The upper surface and bottom surface of the installation groove 14 are open. The right side surface and left side surface of the installation groove 14 are made into insertion surfaces 16, pressing surfaces 18, and fitting surfaces 20 from the upper side to the bottom side. The distance in the lateral direction between the pair of insertion surfaces 16 is greater than the distance in the lateral direction between the pair of pressing surfaces 18, and the distance in the lateral direction between the pair of pressing surfaces 18 is greater than the distance in the lateral direction between the pair of fitting surfaces 20. Further, horizontal upper level surfaces 22 are formed between the insertion surfaces 16 and the pressing surfaces 18, and horizontal lower level surfaces 24 are formed between the pressing surfaces 18 and the fitting surfaces 20.

An insertion recess 26 whose cross-section is rectangular is formed in the center of the rear surface of the installation groove 14. The insertion recess 26 is arranged along the vertical direction and the upper and bottom surfaces thereof are open. A latching protrusion 28 whose cross-section is triangularly shaped is formed inside the insertion recess 26. The front surface of the latching protrusion 28 is inclined in the direction toward the front along the downward direction, and the bottom surface of the latching protrusion 28 is arranged perpendicularly with the vertical direction.

Flat board-shaped front walls 30 are provided in the case 12 at the front end (i.e., at the front side of the installation groove 14). The front walls 30 are arranged from the height of the central portion in the vertical direction of the installation groove 14 and insertion surfaces 16 to the portion of the bottom side.

A guide groove 32 (i.e., guide hole) that appears rectangular when viewed from the front surface is formed to pass through the front walls 30 in the central portion in the lateral direction in order to act as a regulating groove. The guide groove 32 is communicated with the installation groove 14 and the upper surface and bottom surface thereof are open. Guide surfaces 32A are formed in the right side surface and left side surface of the guide groove 32 perpendicular to the lateral direction, and formed on the same flat surfaces as the fitting surfaces 20 of the installation groove 14.

The SMT connector 10 is provided with a substantially rectangular metal peg 34 that acts as a fixing member, as shown in FIGS. 1, 2A, 2B, 3A-3C, and 4A-4C. The peg 34 is inserted into the installation groove 14 of the case 12 and thus installed to the case 12.

A substantially quadrangular latching unit 36 that has elasticity is cutout formed in the center of the peg 34. With regard to the outer periphery of the latching unit 36, the bottom end is formed uniformly with the peg 34 and all other portions besides the bottom end are separated therefrom. The latching unit 36 protrudes toward the rear side from the peg 34. The upper surface of the latching unit 36 is latched to the bottom surface of the latching protrusion 28 of within the insertion recess 26, whereby movement upward relative to the case 12 of the peg 34 is latched.

Substantially rectangular insertion units 38 are formed at both side portions in the lateral direction at the upper portion of the peg 34. The insertion units 38 protrude to the outer sides in the lateral direction of the peg 34. The insertion units 38 of the peg 34 are arranged between the pair of insertion surfaces 16 of the installation groove 14 at a formed height region. The insertion units 38 are latched to the upper level surfaces 22 of the installation groove 14, whereby movement downward relative to the case 12 of the peg 34 is restricted.

Substantially triangular board-shaped pressing units 40 are formed at portions at both sides in the lateral direction in the middle portion of the vertical direction of the peg 34. The pressing units 40 protrude towards the outer sides in the lateral direction of the peg 34. The height position of the pressing units 40 of the peg 34 is arranged so that the pressing units 40 are located between the pressing surfaces 18 of the installation groove 14 when the peg 34 is properly set in the installation groove 14, and accordingly, the pressing units 40 are pressed toward the pressing surfaces 18, whereby movement upward relative to the case 12 of the peg 34 is restricted.

Rectangular board-shaped guide units 42 are cutout formed as regulating portions at both side portions in the lateral direction at the bottom portion of the peg 34. The guide units 42 are bent toward the front side from the peg 34 at 90°, and arranged perpendicular to the lateral direction. The height position of the guide units 42 of the peg 34 is arranged so that the guide units 42 fit between the fitting surfaces 20 of the installation groove 14, and thus, the guide units 42 are in contact with (i.e., press welded to) the guide surfaces 32A of the guide groove 32 of the case 12.

A rectangular board-shaped bent unit 44 is cutout formed as a fixing portion at the central portion in the lateral direction of the bottom end of the peg 34. The bent unit 44 is bent forward in 90° from the peg 34 and arranged perpendicular to the vertical direction.

The SMT connector 10 is mounted (i.e., equipped) on a flat board-shaped print circuit board 46 that is a substrate, as shown in FIG. 1.

A thin board-shaped land 48 made out of metal is formed on the surface of the print circuit board 46. The guide units 42 and bent unit 44 of the peg 34 are fixed to the land 48 with the solder 50, whereby the SMT connector 10 is mounted on the print circuit board 46. Additionally, each of the solder 50 fixing the guide units 42 and the bent unit 44 to the land 48 is mountain-shaped and adhered to the land 48 in a state in which the guide units 42 and bent unit 44 are housed therein.

Next, the functions of the present exemplary embodiment will be explained.

As shown in FIGS. 5A-7B, with the SMT connector 10 of the above configuration, when the peg 34 is installed to the case 12, the peg 34 is inserted into the installation groove 14 of the case 12 from the top thereof to the bottom in the vertical direction (i.e., the direction of installation). Due to this, the pair of insertion units 38 of the peg 34 latch to the pair of the upper level surfaces 22 of the installation groove 14, and the portion where the guide units 42 of the peg 34 are formed fit in between the pair of fitting surfaces 20 of the installation groove 14.

At the same time, the latching unit 36 of the peg 34 is moved downward along the insertion recess 26 of the installation groove 14, whereby the latching unit 36 is temporarily elastically deformed towards the front side by the front surface of the latching protrusion 28 of inside of the insertion recess 26. Then the upper surface of the latching unit 36 is latched to the bottom surface of the latching protrusion 28. Further, the vertical portions where the pressing units 40 of the peg 34 are formed are pressed between the pair of pressing surfaces 18 of the installation groove 14, and the pair of pressing units 40 is pressed toward the pair of pressing surfaces 18. Due to this, movement upward of the peg 34 relative to the case 12 is restricted, and thus, dropping out of the peg 34 from the case 12 can be prevented.

When the peg 34 is installed to the case 12, the pair of guide units 42 provided at the peg 34 along the vertical direction is guided along the pair of guide surfaces 32A of the guide groove 32 provided at the case 12 along the vertical direction. For this reason, for example, even if the peg 34 is tilted in the left or right direction relative to the case 12, the pair of guide units 42 contact the pair of guide surfaces 32A, whereby tilting of the peg 34 in the left or right direction relative to the case 12 is restricted. Due to this, slanted installation of the peg 34 to the case 12 as well as scraping of the case 12 by the peg 34 can be prevented.

Further, the guide units 42 are bent perpendicularly relative to the peg 34. For this reason, when the peg 34 is installed to the case 12, the peg 34 contacts the front and rear surfaces of the installation groove 14 (at the front walls 30), whereby inclination of the peg 34 toward the front and rear directions of the case 12 can be regulated or controlled. Further, as described above, the pair of guide units 42 contacts the pair of guide surfaces 32A, whereby rightward or leftward inclination of the peg 34 with respect to the case 12 can be regulated or controlled. Due to this, slanted installation of the guide grooves 32 to the case 12 can be effectively suppressed.

In addition, the peg 34 is fixed to the land 48 of the print circuit board 46 at the bent unit 44 with the solder 50, and therefore, the peg 34 can be solidly fixed to the land 48 and the print circuit board 46 can be solidly equipped with the SMT connector 10.

Further, the peg 34 is fixed at the guide units 42 to the land 48 of the print circuit board 46 with the solder 50. Also, the guide units 42 stand up perpendicularly relative to the print circuit board 46 so the adhesion height of the solder 50 to the guide units 42 can be made higher. For this reason, the peg 34 can be fixed further solidly to the land 48, and the print circuit board 46 can be equipped with the SMT connector 10 further solidly.

Note that with the present exemplary embodiment, the configuration is such where the guide grooves 32 are provided at the case 12 and the guide units 42 are provided at the peg 34. Nonetheless, the configuration can be made so that the guide units 42 (regulating grooves) are provided at the case 12 and the guide grooves 32 (regulating grooves) are provided at the peg 34.

What is claimed is:

1. A connector configuration comprising:

a board shaped fixing member that is a component of a connector and is fixed to a substrate in order to mount the connector onto the substrate;

a case that is a component of the connector and has an installation groove formed thereon, into which installation groove the board shaped fixing member is inserted toward the substrate and installed, wherein said installation groove includes a front open portion defined by opposing side walls; and a regulating portion provided at either side of the fixing member along a direction of installation of the fixing member onto the case and formed by bending a portion of the fixing member so as to protrude from said board shaped fixing member; wherein a regulating groove is defined along the direction of installation on the case by said opposing side walls, and when the fixing member is installed onto the case, the regulating portions are guided along the regulating groove and tilting of the fixing member relative to the direction of installation is controlled.

2. The connector configuration of claim 1, further comprising a fixing portion that is formed so as to protrude from the fixing member and is fixed to the substrate.

3. The connector configuration of claim 2, wherein said fixing portion is formed by bending a portion of the fixing member so as to protrude from said board shaped fixing member.

4. The connector configuration of claim 2, wherein said board-shaped fixing member further includes a plate spring latching unit formed by cutting out a central portion of said board shaped fixing member.

5. A connector configuration comprising:

a board shaped fixing member that is a component of a connector and is fixed to a substrate in order to mount the connector onto the substrate;

a case that is a component of the connector and has an installation groove formed thereon, into which installation groove the board shaped fixing member is inserted toward the substrate and installed, wherein said installation groove includes a front open portion defined by opposing side walls;

a fixing portion that is formed by bending a portion of the fixing member so as to protrude from a bottom edge of the board shaped fixing member and which is fixed to the substrate;

a plate spring latching unit formed by cutting out a central portion of said board shaped fixing member that latches on a central portion of said installation groove, and a regulating portion provided at either side of the fixing member along a direction of installation of the fixing member onto the case and formed by bending bottom side portions of the fixing member so as to protrude from said board shaped fixing member; wherein a regulating groove is defined along the direction of installation on the case by said opposing side walls, and when the fixing member is installed onto the case, the regulating portions are guided along the regulating groove and tilting of the fixing member relative to the direction of installation is controlled.

* * * * *